United States Patent [19]

Carruthers

[11] 4,248,378

[45] Feb. 3, 1981

[54] SELF PRIMING DEVICES FOR INDIRECT DOMESTIC WATER HEATING SYSTEMS

[75] Inventor: Thomas R. Carruthers, Glasgow, Scotland

[73] Assignee: Fleming Fabrications Limited, Glasgow, Scotland

[21] Appl. No.: 9,805

[22] Filed: Feb. 6, 1979

[30] Foreign Application Priority Data

Jul. 13, 1978 [GB] United Kingdom ..... 29725/78

[51] Int. Cl.[3] ..... F24D 3/10

[52] U.S. Cl. ..... 237/66; 237/56; 237/19; 126/362; 137/59

[58] Field of Search ..... 237/59, 66, 19; 137/59; 220/20.5, 209, 367; 126/362

[56] References Cited

FOREIGN PATENT DOCUMENTS

| | | | |
|---|---|---|---|
| 2136272 | 2/1973 | Fed. Rep. of Germany | 237/66 |
| 118310 | 11/1945 | Norway | 237/66 |
| 1421533 | 1/1976 | United Kingdom | 237/19 |

*Primary Examiner*—Albert J. Makay
*Assistant Examiner*—Henry Bennett
*Attorney, Agent, or Firm*—Larson, Taylor and Hinds

[57] ABSTRACT

This invention relates to self-priming devices for indirect domestic water heating systems which device acts as expansion and contraction chambers for primary and secondary water in the system. The device consists of a closed housing divided internally by a wall intermediate its ends to form axially disposed first and second chambers. A open ended tubular member extends from the wall into the second chamber to provide communication between the chambers and an inlet and outlet is provided in the second chamber adjacent the wall. At least one inlet is provided in the first chamber at the end remote from the wall. The first chamber is connected to a primary water circuit and the second chamber is connected to the secondary water circuit to separate the water in one circuit from the water in the other circuit. The volume of the first chamber is substantially 4 to 4.5% of the volume of water content of the primary circuit and the volume of the portion of the second chamber between the inlet and outlet and the end of the tubular member being substantially equal to the volume of the first chamber and an auto vent device is located adjacent the end of the first chamber remote from the wall.

4 Claims, 6 Drawing Figures

SELF PRIMING DEVICES FOR INDIRECT DOMESTIC WATER HEATING SYSTEMS

This invention relates to self-priming devices for indirect domestic water heating systems.

More specifically the invention provides for self-priming devices which can be incorporated in existing domestic water heating systems to convert the system into an indirect water heating system which may or may not include a pumped or gravity fed central heating system.

An indirect domestic water heating system is a system whereby domestic water in a storage cylinder is heated by means of a heat exchanger located in the storage cylinder. Water in a primary heating circuit is heated in a boiler or the like and is passed through the heat exchanger, the heat exchanger transferring heat from the primary water to the secondary water without the primary and secondary waters mixing. The primary water may be in a central heating system and may be gravity fed or pumped.

Feed water for the primary and secondary circuits are supplied from a common source such as a storage tank but care must be taken to ensure that the primary water after it has entered the primary circuit does not enter and mix with the secondary water.

The self-priming device of the present invention provides for isolating the circuits.

The water in the primary circuit is separated from the water in the secondary circuit by a self-priming device according to the invention which acts as an expansion and contraction chamber for both circuit.

The self-priming device is connected externally of the domestic hot water cylinder to the heat exchanger inlet in a primary circuit and to a vent in a secondary circuit.

It is known from our British Pat. Nos. 1421532 and 1421533 to provide a compensator device between the primary water circuit and the secondary water circuit to isolate the circuits from each other during operation of the heating system when cold water is supplied to both circuits from a common source.

It has been found that the compensator devices of the prior specifications have the disadvantage that the lower chamber is filled with primary water during operation and during the initial heat up period the primary water in the lower chamber expands into the upper chamber and mixes with the secondary water in the upper chamber.

The self-priming device of the present invention provides for automatic venting of the primary circuit which obviates the disadvantage of the prior constructions and provides for a more efficient system.

The self-priming device of the present invention has been designed to offer a method of simplifying the design and reducing the cost of indirect domestic water heating systems and also ensures that the primary and secondary waters are isolated from each other as heating and cooling occurs and ensures automatic topping up of the primary circuit should leakage or evaporation losses occur.

A self-priming device for indirect domestic water heating systems comprises a closed housing divided internally by a wall intermediate its ends to form axially disposed first and second chambers, an open ended tubular member extending from said wall into the second chamber to adjacent the opposite end of the chamber to provide communication between the chambers, an inlet and an outlet at the end of the second chamber adjacent said wall and at least one opening at the end of the first chamber remote from said wall, said inlet and outlet being so arranged as to be connectible to an outlet from a domestic hot water cylinder and a vent to atmosphere and the opening or openings in the first chamber being connectible to a primary water heating circuit which includes a heat exchanger located in the domestic hot water cylinder, the volume of the first chamber being substantially 4 to 4.5% of the volume of the water content of the primary circuit, the volume of the portion of the second chamber between the inlet and outlets and the end of the tubular member being substantially equal to the volume of the first chamber, and an auto vent device located adjacent the end of the first chamber remote from said wall.

Preferred embodiments of the invention are illustrated by way of example in the accompanying drawings in which.

Figure 1:
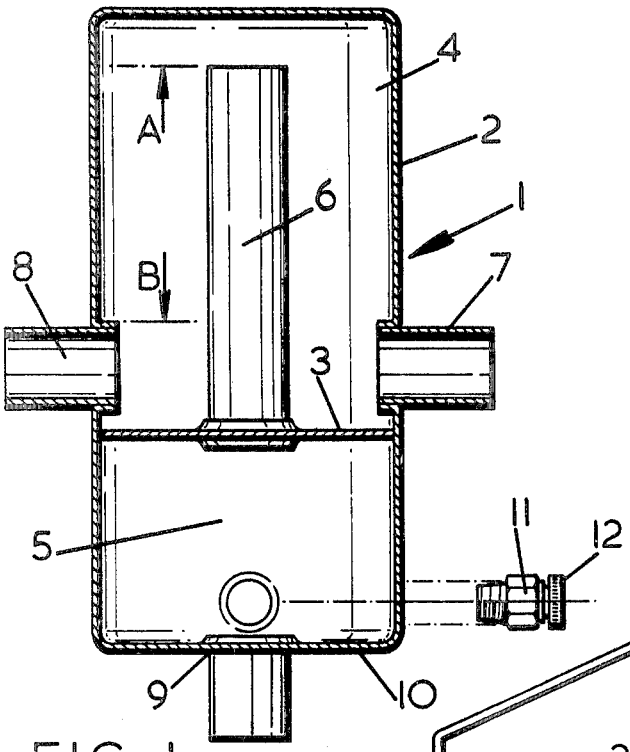
FIG. 1 is a sectional view of a self-priming device according to one embodiment of the invention.

Referring to FIG. 1 of the drawings a self-priming device indicated generally at 1 comprises a tubular housing 2 closed at both ends and divided internally intermediate its ends by a wall 3 to form a chamber 4 and a chamber 5.

A tubular member 6 open at both ends extends from the wall 3 into the chamber 4 to provide communication between the two chambers.

An inlet 7 and an outlet 8 is provided at the end of the chamber 4 adjacent the wall 3 and an opening 9 is provided in the bottom 10 of the chamber 5 remote from the wall 3.

An auto vent device 11 is provided in the wall 3 of the chamber 5 at the lower end of the chamber remote from the wall 3.

The auto vent device 11 is automatically actuated and may be in the form of a valve having absorbent diaphragm washers 11*a* which swell when wet to close the valve and when dry contract to provide a passage through the valve. A manually actuated screw threaded member 12 is also provided for manual operation of the valve and a screw threaded member 12*a* provides for setting the valve to open a predetermined amount when dry or substantially dry.

It is essential that the auto vent device is located at the lower end of the chamber 5 so that the chamber 5 is filled with air when the device is in operation thus providing an air seal between the primary and secondary water to keep them apart.

The volume of the lower chamber 5 is arranged to be at least equal to the volume of the portion A-B of the upper chamber 4.

Figure 2:
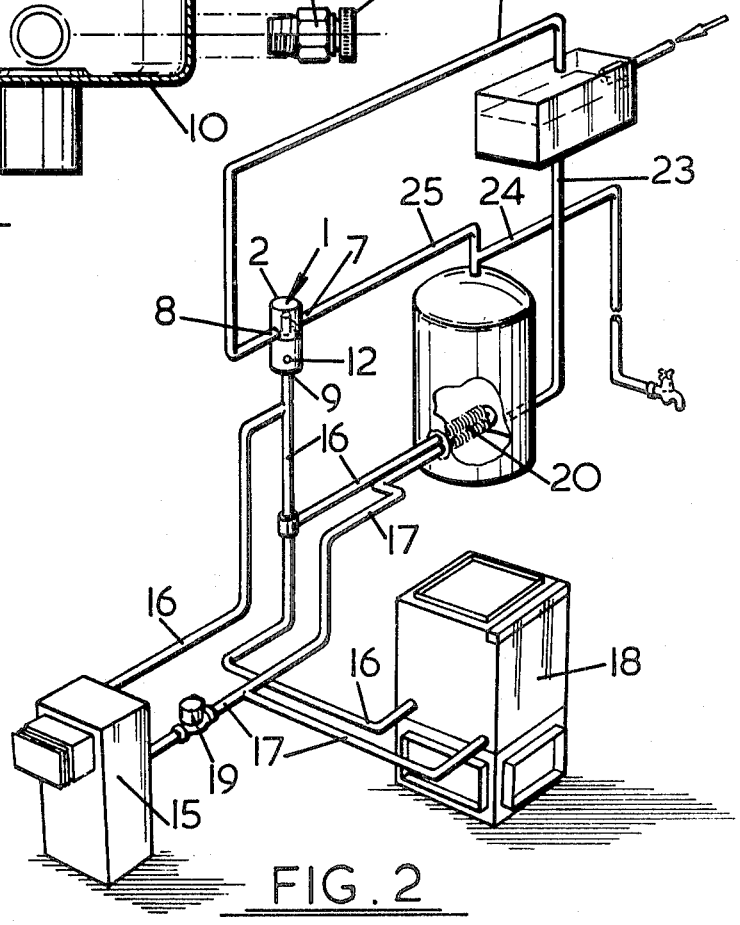
FIG. 2 illustrates the self-priming device of FIG. 1 incorporated in an indirect domestic water heating system.

Referring to FIG. 2 of the drawings the self-priming device 1 is incorporated in a pumped primary circuit of an indirect domestic hot water heating system in which the opening 9 is connected to the flow side of a primary water heating system which includes a boiler or water heating source 15 and flow pipes for conducting heated water round a circuit and return pipes 17 for returning the water to the boiler 15.

A space heating unit 18 or radiators (not shown) may be incorporated in the circuit in known manner.

A pump 19 shown in the return side of the primary circuit may be incorporated in the flow side of the circuit.

A heat exchanger 20 is connected to the flow and return circuits in the primary circuit and provides for indirectly heating a secondary circuit comprising domestic hot water in a hot water storage cylinder 21 which is supplied with cold water from a header tank 22 through a pipe 23 connected to the lower end of the cylinder 21. An outlet 24 for domestic hot water supply and a vent pipe 25 are connected to the upper end of the cylinder 21. The outlet 24 and vent 25 may have a common outlet from the cylinder as illustrated or the outlet and vent may be separate.

The vent 25 is connected to the inlet 7 of the self-priming device and the outlet 8 of the self-priming device is vented to atmosphere through a pipe 26.

The vent valve 11 is manually operated to vent the primary circuit so that the circuit can be filled with cold water from the secondary circuit. When the primary circuit is filled, i.e. to a level just below the vent valve 11 the valve is manually closed thus allowing the valve to actuate automatically the lower chamber 5 or 34 being full of air providing a seal between the primary and secondary waters.

When the primary circuit is filled with water the boiler 15 heats the water in the primary circuit which is circulated by the pump 19. Water circulating through the heat exchanger heats the water in the secondary circuit and the self-priming device provides for keeping the primary and secondary water separate by providing a volume of air in the chambers between the primary water and the secondary water and also acts as an expansion and contraction chamber for both circuits. The air in the chambers is provided by air released from the heated water.

The volume of the lower chamber of the self-priming device is made to represent approximately 4 to 4.5% of the total water content of the primary circuit.

The self-priming device above described is particularly suitable for a pumped primary circuit but it can also be used in a gravity system.

Figure 3:
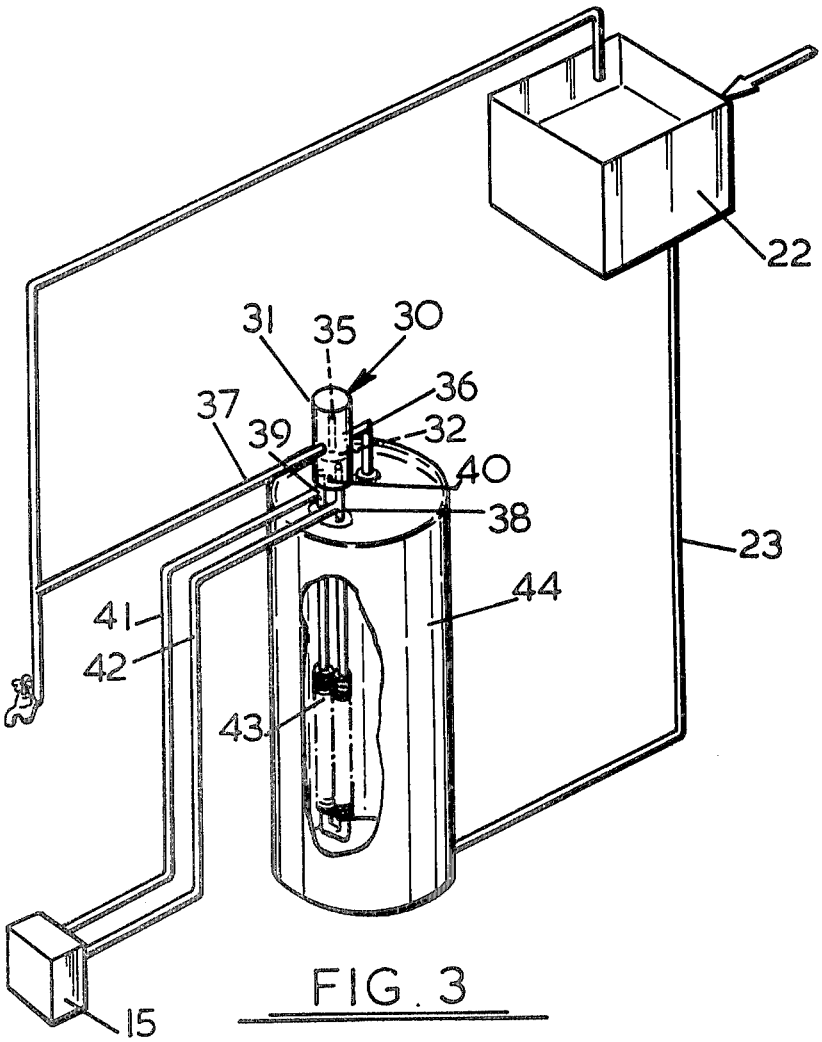
FIG. 3 illustrates a self-priming device according to another embodiment of the invention incorporated in an indirect domestic water heating system.
Figure 4:
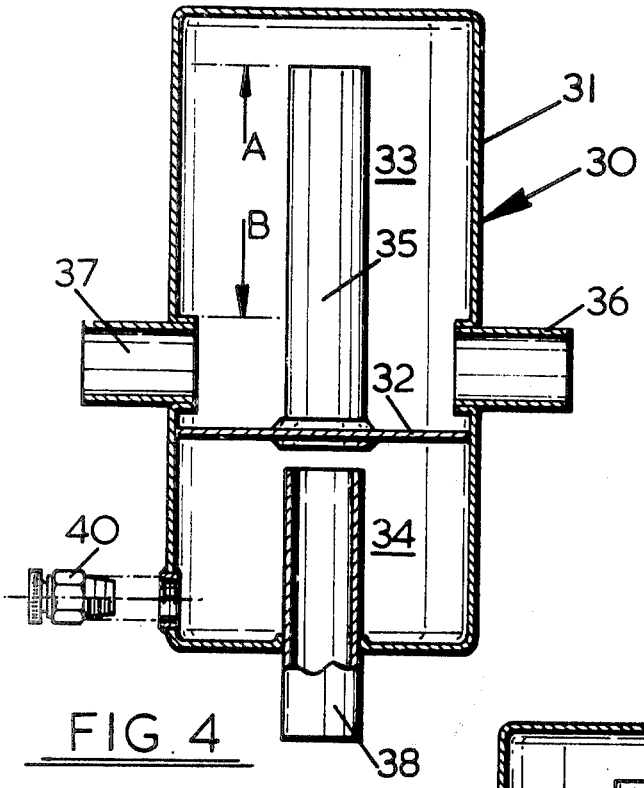
FIG. 4 is a sectional view of the self-priming device along the line Y—Y of FIG. 3.
Figure 6:
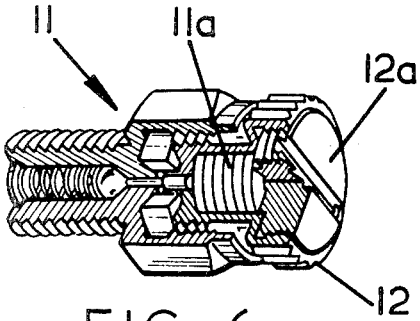
FIG. 6 is a partly sectional view of a vent valve.
Figure 5:
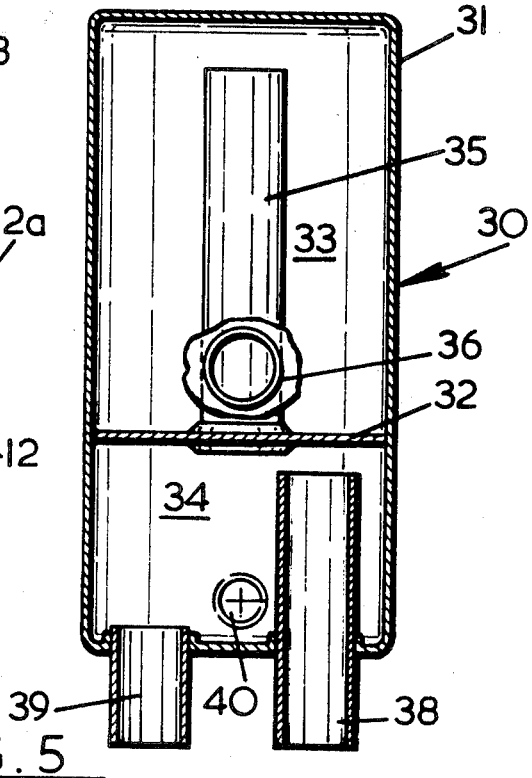
FIG. 5 is a sectional view of the self-priming device along the line X—X of FIG. 3.

Referring to FIGS. 3 to 5 a modified self-priming device is illustrated which is suitable for use in a gravity fed primary heating circuit as illustrated in FIG. 3.

The modified self-priming device indicated generally at 30 comprises a housing 31 closed at both ends and internally divided intermediate its ends by a wall 32 to form two chambers 33 and 34.

An open ended tubular member 35 extends upwardly from the wall 32 into the chamber 33 to provide for communication between the chambers and the chamber 33 is provided with an inlet 36 and outlet 37 corresponding to the inlet 7 and outlet 8 of the self-priming device 1.

The volume of the chamber 34 is at least equal to the volume of the portion A-B of the chamber 33 and as in the case of the device 1 the volume of the chamber 34 is made to be approximately 4 to 4.5% of the total water content of the primary circuit of an indirect domestic water heating circuit in which the device is to be used.

The chamber 34 is provided with two openings 38 and 39.

A vent valve 40 of the same type as the valve 11 of the self-priming device 1 is also provided at the lower end of the chamber 34.

The openings 38 and 39 are connected to the flow 41 and return 42 of a heat exchanger 43 in a primary water heating circuit, the heat exchanger being located in a domestic hot water cylinder 44 to heat water in a secondary circuit for domestic use. The inlet 36 is connected to a draw-off for domestic hot water from the cylinder and to a vent to atmosphere.

The vent valve 11 or 40 may be replaced by an automatic float air vent valve wherein a float member is housed in a chamber to actuate a vent valve when water in the chamber falls below a predetermined level. The valve is also manually operable.

What is claimed is:

1. A self-priming device for indirect domestic water heating systems comprising:

a closed housing divided internally by a wall intermediate to its ends to form axially disposed first and second chambers, said first chamber being disposed below said second chamber when the device is in use;

an open-ended tubular member extending from said wall into the second chamber with its distal end adjacent the end of the second chamber to provide fluid communication between the first and second chambers;

said second chamber having an inlet and an outlet located adjacent said wall said inlet providing expansion means for a domestic hot water system into said second chamber, and said outlet providing means for venting said second chamber to atmosphere, the volume of the portion of the second chamber between the inlet and outlet and the distal end of said open-ended tubular member being substantially equal to the volume of said first chamber; and an auto vent located adjacent the end of the first chamber remote from said wall for venting said first chamber to atmosphere, said auto vent being positioned to contact fluid present in said first chamber and including means responsive to water whereby when water is present in said first chamber said auto vent is closed and when air is present in said first chamber said auto vent is open;

said first chamber having an opening adjacent the end of said first chamber remote from said wall for placing said first chamber in fluid communication with a flow of a primary heating water.

2. A device according to claim 1 wherein said auto vent comprises a water absorbent diaphragm which closes the vent when wet and opens the vent when dry.

3. An indirect domestic hot water heating system comprising:

a primary water heating circuit comprising a water heating means, a heat exchanger, and conduit means for conducting a flow of primary heating water therebetween;

a secondary water heating circuit comprising a hot water storage cylinder and a header tank for supplying cold water to said cylinder and said primary water heating circuit, said heat exchanger of said primary water heating circuit being located in said cylinder for heating cold water therein by indirect heat exchange; and a self-priming device according to claim 1;

conduit means connecting said opening of said first chamber to said conduit means of said primary water heating circuit; and further conduit means connecting said inlet of said second chamber to said conduit means of said secondary water heating circuit.

4. A system according to claim 3 wherein the volume of said first chamber is about 4 to 4.5% of the volume of the water content of the primary water heating circuit.

* * * * *